United States Patent [19]

Tanimoto et al.

[11] 4,170,889

[45] Oct. 16, 1979

[54] METHOD AND APPARATUS FOR ROLL-FORMING AN END PLATE

[75] Inventors: Tateo Tanimoto, Saeki; Yukio Hiasa, Hiroshima; Hidehiko Tsukamoto, Saeki; Tetsuo Ichikizaki, Hiroshima; Akihiro Shindo, Saeki; Akira Wakayama, Hiroshima, all of Japan

[73] Assignee: Mitsubishi Jukogyo Kabushiki Kaisha, Tokyo, Japan

[21] Appl. No.: 913,693

[22] Filed: Jun. 8, 1978

[30] Foreign Application Priority Data

Jun. 8, 1977 [JP] Japan ..... 52-66775

[51] Int. Cl.[2] ..... B21D 22/16

[52] U.S. Cl. ..... 72/85; 72/83

[58] Field of Search ..... 72/82, 83, 84, 85, 86, 72/87, 110

[56] References Cited

U.S. PATENT DOCUMENTS

| | | | |
|---|---|---|---|
| 2,287,091 | 6/1942 | Cushwa et al. | 72/85 |
| 3,580,025 | 5/1971 | Hayashi | 72/84 |

FOREIGN PATENT DOCUMENTS

| | | | |
|---|---|---|---|
| 441072 | 12/1944 | U.S.S.R. | 72/82 |

*Primary Examiner*—Lowell A. Larson

*Attorney, Agent, or Firm*—Wenderoth, Lind & Ponack

[57] ABSTRACT

Upon roll-forming an end plate of hemispherical and other cup-like or dish-like configurations, a raw material disc is placed between outer die means consisting of a top outer forming die that can be vertically moved by a drive source and can be freely rotated and at least a pair of left and right outer forming rolls adapted to move along predetermined moving paths and inner die means consisting of a top inner forming die held at a predetermined position that can be driven in rotation by a drive source, and a middle inner forming roll a bottom inner roll both of which are freely rotatable, the outer die means is depressed against the inner die means, and said pair of outer forming rolls are moved along said moving paths so as to press said raw material disc against the middle inner forming roll and the bottom inner forming roll, respectively, one of said outer forming rolls being moved within an effective forming range of the middle inner forming roll, while the other being moved within an effective forming range of the bottom inner forming roll. The effective forming ranges of the middle and bottom inner forming rolls, respectively, are partly overlapped with each other. In an apparatus for effecting the above-described roll-forming operation, an effective forming angle of the bottom inner forming roll is chosen larger than an effective forming angle of the middle inner forming roll.

4 Claims, 12 Drawing Figures

METHOD AND APPARATUS FOR ROLL-FORMING AN END PLATE

The present invention relates to a method and apparatus for roll-forming an end plate of hemispherical and other cup-like or dish-like configurations as defined by any suitable surface of revolution (such as paraboloid, hyperboloid, conical, etc. configurations) from a raw material disc.

Firstly, representative examples of the heretofore known methods and apparatuses for roll-forming the above-described type of end plates will be generally described with reference to FIGS. 1 and 2, in order to highlight the disadvantages of the methods and apparatuses in the prior art.

Figure 1:
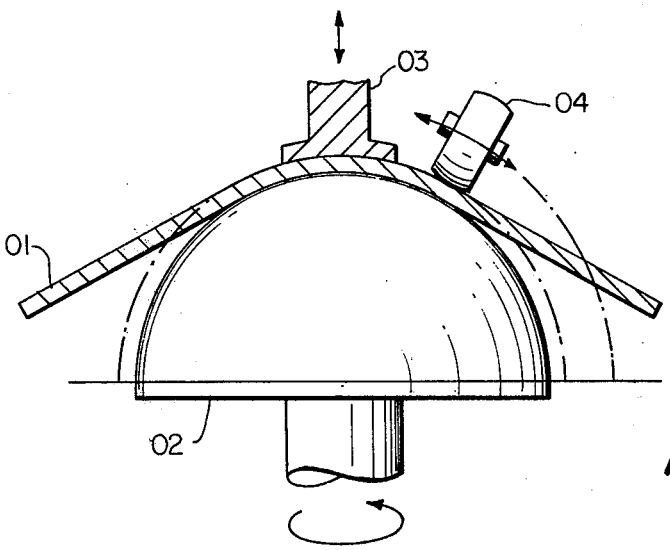

One example shown in FIG. 1 is a roll-forming technique disclosed in U.S. Pat. No. 3,355,920 issued to George W. Ellenburge on Dec. 5, 1967. In this figure, reference numeral 02 designates a disc-shaped workpiece, and numeral 01 designates an inner forming die or a spinning mandrel, that is adapted to be driven in rotation as shown by an arrow. Reference numeral 03 designates a top outer forming die or an arbor, which is adapted to form a top portion of the workpiece 01 by pressing it against the inner forming die 02, and which can be vertically moved as shown by arrows and is freely rotatable without being driven. Reference numeral 04 designates an outer forming roll, which is adapted to form the workpiece 01 by pressing it against the inner forming die 02 while moving along a predetermined path as shown by arrows, and which is freely rotatable without being driven.

Figure 3:
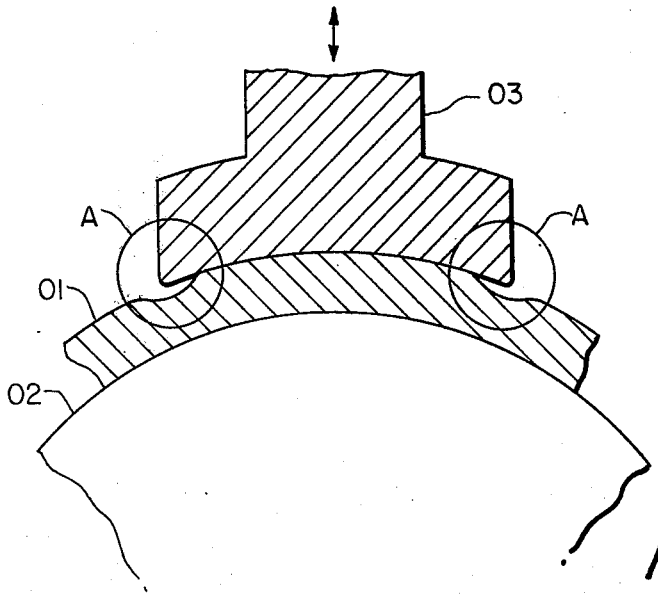

In this example of the known technique, after a top portion of a workpiece 01 has been formed by pressing the workpiece 01 against the inner forming die 02 with the top outer forming die 03, the remaining portion of the workpiece 01 is formed by pressing it against the inner forming die 02 with the outer forming roll 04 while the outer forming roll 04 is moved along the surface of the inner forming die 02, and therefore, this prior art technique has the following disadvantages:

(a) The top outer forming die 03 is necessitated not only to form the top portion of the workpiece 01 by pressing the workpiece 01 against the inner forming die 02, but also to transmit a strong driving torque for overcoming the forming force exerted by the outer forming roll 04 upon forming the workpiece 01 with the outer forming roll 04 from the inner forming die 02 to the workpiece 01 as a frictional force depending upon the pressing force exerted by the top outer forming die 03, and consequently, the scope of forming effected by the top outer forming die 03 must be relatively large. Therefore, in the case of a workpiece having a large forming curvature at the top portion such as a hemispherical end plate, forming defects and thinning of the workpiece 01 caused by the top outer forming die 03 upon forming the top portion as shown in FIG. 3, are liable to occur.

(b) Since the forming of the portion other than the top portion is effected by means of a single outer forming die 04, the forming operation requires a high degree of skill, and so, if the forming operation is carried out by forcibly pressing the workpiece 01 against the inner forming die 02, then the precision of forming is so poor that in some part of the workpiece 01 occurs thinning of even several tens percents.

Figure 2:
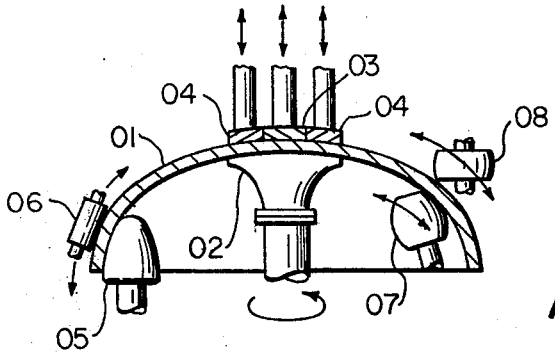

The other example shown in FIG. 2 is a roll-forming technique disclosed in Japanese Patent Publication Nos. 46-11968 and 47-14690 filed by K. K. Hokkai Tekkojo in Osaka and issued on Mar. 27, 1971 and May 2, 1972, respectively. The constructions and operations of the apparatus are fully described in the specifications and illustrated in the drawings of these patent publications, and so, further description thereof will be omitted here. However, it is to be noted that with the method and apparatus disclosed in these prior art references, it is difficult to form a hemispherical end plate as shown in FIG. 1 of the present application from the following reasons:

As will be apparent by comparing FIG. 1 with FIG. 2, in the case of forming a hemispherical end plate the amount of forming (the amount of plastic deformation) is larger than that in the case of forming end plates as shown in the above-referred Japanese patent publications. If the hemispherical end plate should be formed by means of the apparatus shown in FIG. 2;

(i) then what support the workpiece 01 are only an upper central support 03, an upper peripheral support 04 and a lower support 02 at the top portion, and after the forming has been effected, the remaining portions of the workpiece 01 are compelled to support themselves with the rigidity of the workpiece 01 per se. In the case of the hemispherical end plate, however, since the amount of forming is large as described above, and also the weight of the workpiece itself results in a productive effect, so that these forces cannot be withstood only by the rigidity of the workpiece 01 itself, resulting in further deformation of the formed end plate, and therefore it becomes difficult to form a predetermined shape of hemispherical end plate.

(ii) If the method of forming an end plate with the apparatus shown in FIG. 2 in which (a) at first the top portion of the workpiece 01 is formed by means of the above-mentioned members 02, 03 and 04, (b) then forming of the peripheral portion is effected by means of auxiliary rollers 05 and 06, and (c) thereafter the remaining portion is formed by means of forming rollers 07 and 08, should be employed for forming the hemispherical end plate, then because of the aforementioned large amount of forming, the peripheral portion which has been formed by the step (b) would be subjected to deformation at the same time when the forming in the step (c) is effected, and eventually reforming would become necessary. In this case, upon forming by means of the forming rollers 07 and 08 in the step (c), the disadvantage as referred to in paragraph (i) above will be further enhanced. In case where the reforming is effected by means of the same auxiliary rollers 05 and 06 used in the step (b) in the first forming operation, the positions of these auxiliary rollers upon forming in the step (b) and their positions upon reforming are largely different, so that resetting of the auxiliary rollers 05 and 06 becomes necessary, and it is very difficult in view of the structure of the apparatus to carry out this resetting in the middle of the step (c).

Since the roll-forming method and apparatus in the prior art was accompanied by the aforementioned disadvantages, upon forming a hemispherical end plate in the past it was a common practice to carry out integral press forming with a large-sized press or to form it by assembling separately formed workpieces together through welding, and in either case there were disadvantages in that expansion of installations, difficulty in operations and enhancement of manufacturing cost were resulted.

Therefore, it is one object of the present invention to provide a method and apparatus for roll-forming an end plate of hemispherical or other similar configurations which is free from the aforementioned disadvantages.

According to one feature of the present invention, there is provided a method for roll-forming an end plate characterized by the steps of placing a raw material disc between outer die means and inner die means, said outer die means consisting of a top outer forming die that can be vertically moved by a drive source and can be freely rotated and at least a pair of left and right outer forming rolls adapted to move along predetermined moving paths, said inner die means consisting of a top inner forming die held at a predetermined position that can be driven in rotation by a drive source, and a middle inner forming roll and a bottom inner forming roll both of which are freely rotatable; depressing said outer die means against said inner die means with said raw material disc clamped therebetween; and moving said pair of outer forming rolls along said moving paths so as to press said raw material disc against said middle inner forming roll and said bottom inner forming roll, respectively, one of said outer forming rolls being moved within an effective forming range of said middle inner forming roll, while the other being moved within an effective forming range of said bottom inner forming roll, and the effective forming ranges of said middle and bottom inner forming rolls, respectively, being partly overlapped with each other, whereby said raw material disc may be formed into a desired configuration defined by any suitable surface of revolution.

According to another feature of the present invention, there is provided an apparatus for roll-forming an end plate, characterized in that said apparatus comprises outer die means consisting of a top outer forming die that can be vertically moved by a drive source and can be freely rotated and at least a pair of left and right outer forming rolls adapted to move along predetermined moving paths, and inner die means consisting of a top inner forming die held at a predetermined position that can be driven in rotation by a drive source and a middle inner forming roll and a bottom inner forming roll both of which are freely rotatable, that when said pair of outer forming rolls move along their moving paths, one of the rolls is adapted to be pressed against said middle inner forming roll within its effective forming range while the other is adapted to be pressed against said bottom inner forming roll within its effective forming range, that the effective forming ranges of said middle and bottom inner forming rolls, respectively, are partly overlapped with each other, and that an effective forming angle of said bottom inner forming roll is chosen larger than an effective forming angle of said middle inner forming roll.

According to still another feature of the present invention, the above-featured method and apparatus for roll-forming an end plate are further characterized in that said top outer forming die is composed of a top central outer die having at its bottom end a disc-shaped flexible die plate provided with at least one radial notch at its peripheral portion that can be vertically moved by a drive source, and a top peripheral outer die disposed coaxially with and around said top central outer die that can be vertically moved by a drive source, whereby said raw material disc may be pressed against said top inner forming die by said top central outer die and said top peripheral outer die by the intermediary of said disc-shaped flexible die plate.

Figure 4:
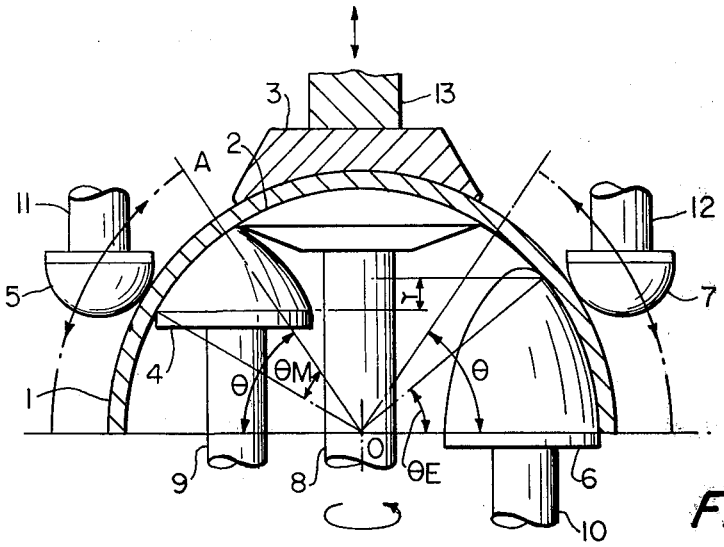
Figure 5:
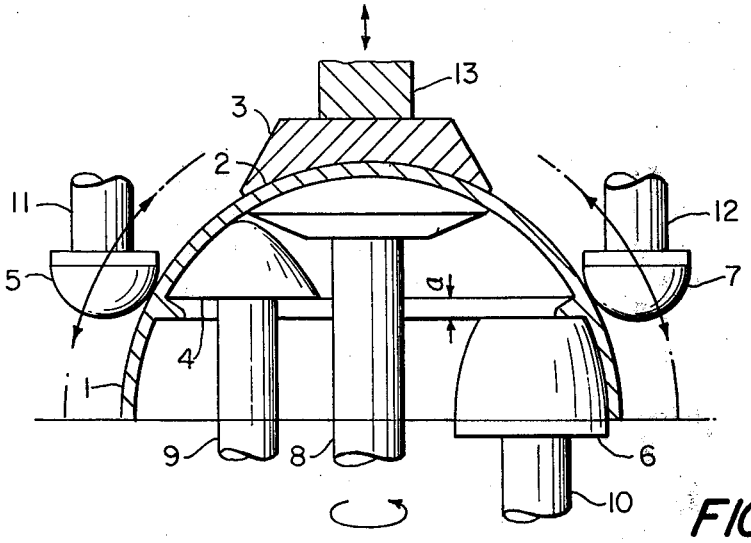
Figure 6:
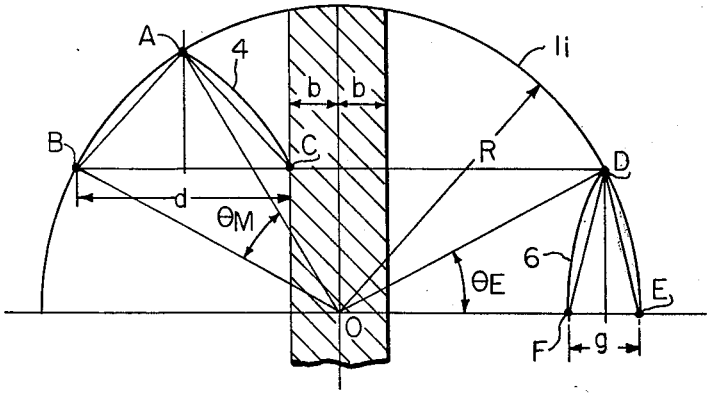
Figure 7:
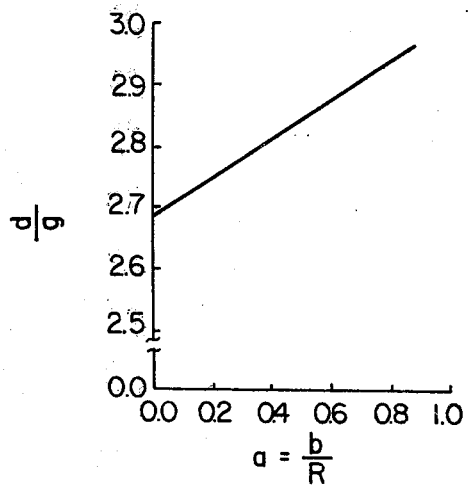
Figure 8:
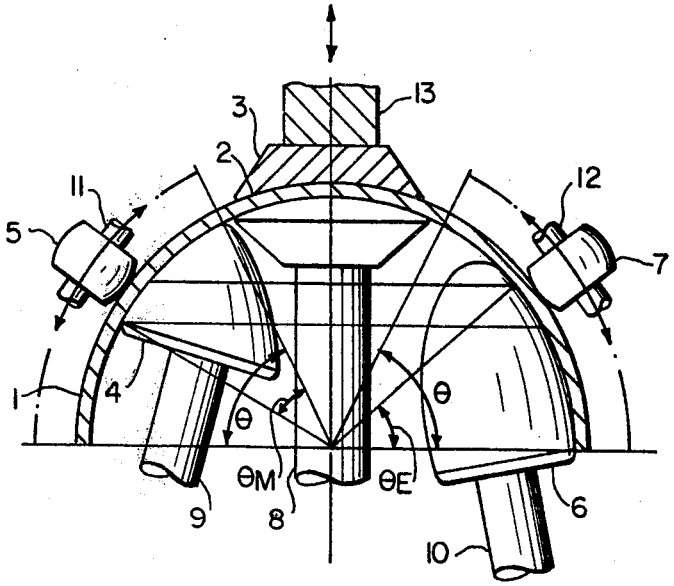
Figure 9:
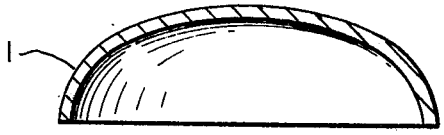
Figure 10:
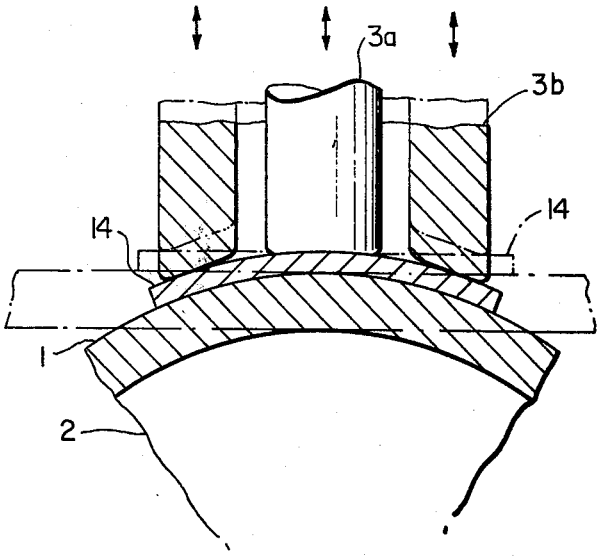
Figure 11:
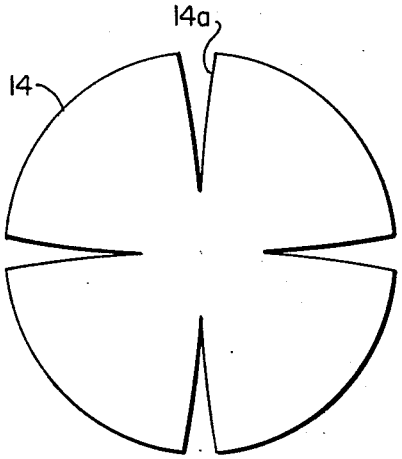
Figure 12:
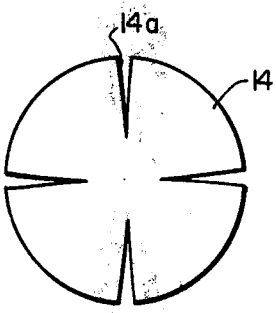

Above-mentioned and other features and objects of this invention will become more apparent by reference to the following description taken in conjunction with the accompanying drawings, in which:

FIGS. 1 and 2 are schematic views showing examples of the method and apparatus for roll-forming an end plate in the prior art, FIG. 3 is a schematic view showing generation of defects according to the prior art method illustrated in FIG. 1, FIG. 4 is a schematic view showing one preferred embodiment of the present invention, FIGS. 5, 6 and 7 are a schematic view, a diagrammatic view and a diagram, respectively, to be used for explaining the effects of the present invention, FIG. 8 is a schematic view showing a second preferred embodiment of the present invention, FIG. 9 is a cross-section view of one example of end plates formed according to the present invention, FIGS. 10 and 11 are schematic views showing a third preferred embodiment of the present invention, FIG. 10 being a structural view of an essential part of the third preferred embodiment, and FIG. 11 being a plan view of a disc-shaped flexible die plate to be used in the third preferred embodiment, and FIG. 12 is a plan view of another example of the disc-shaped flexible die plate.

Now the method and apparatus according to the present invention will be explained in greater detail, by way of example, with reference to FIG. 4 of the accompanying drawings.

In FIG. 4, die means for forming inside of a raw material disc 1 consists of a top inner forming die 2, a middle inner forming roll 4 and a bottom inner forming roll 6. The top inner forming die 2 is fixedly secured to a drive shaft 8, which is adapted to be driven in rotation by a driving device not shown as shown by an arrow in FIG. 4, and which is fixed in position. The middle inner forming roll 4 is fixedly secured to a support shaft 9, which is not driven but is freely rotatable. The bottom inner forming roll 6 is fixedly secured to a support shaft 10, which is not driven but is freely rotatable. The inner forming rolls 4 and 6 are mounted on the opposite sides of the top inner forming die 2, and after they have been set at predetermined positions so as to establish inner forming die means, they are fixed in position so that they may not be displaced during the forming of the raw material disc 1. As shown by an overlapping amount r in FIG. 4, the effective forming ranges of the inner forming rolls 4 and 6, respectively, are partly overlapped with each other so as to realize smooth continuation between the forming dies established by the inner forming rolls 4 and 6, respectively.

Die means for forming outside of a raw material disc 1 consists of a top outer forming die 3 and outer forming rolls 5 and 7. The top outer forming die 3 is fixedly secured to an elevator shaft 13 which is freely rotatable. The top outer forming die 3 can be moved up and down by means of an elevator device not shown as shown by arrows in FIG. 4, and owing to this elevator device, the raw material disc 1 is pressed against the top inner forming die 2 by the top outer forming die 3 to form the top portion of the raw material disc 1.

The middle outer forming roll 5 is disposed on the opposite side of the raw material disc 1 to the middle inner forming roll 4, is fixedly secured to a support shaft 11 and is freely rotatable without being driven. The middle outer forming roll 5 is moved by a moving device not shown as indicated by arrows in FIG. 4 so as to press the raw material disc 1 against the middle inner forming roll 4. The range of movement of this forming roll 5 is the range represented by an angle $\theta$ in FIG. 4. Normally, a principal forming range of the middle outer forming roll 5 is equal to the effective forming range of the middle inner forming roll 4 (the range represented by an angle $\theta_M$ in FIG. 4).

The bottom outer forming roll 7 is disposed on the opposite side of the raw material disc 1 to the bottom inner forming roll 6, is fixedly secured to a support shaft 12, and is freely rotatable without being driven. The bottom outer forming roll 7 is moved by a moving device not shown as indicated by arrows in FIG. 4 so as to press the raw material disc 1 against the bottom inner forming roll 6. The range of movement of this forming roll 7 is the range represented by an angle $\theta$ in FIG. 4 (The same moving range as that of the middle outer forming roll 5). Normally, a principal forming range of the bottom outer forming roll 7 is equal to the effective forming range of the bottom inner forming roll 6 (the range represented by an angle $\theta_E$ in FIG. 4).

It is to be noted that the movement of the outer forming rolls 5 and 7 can be realized by any well-known technique such as a method employing an arcuated path driving mechanism or a method of achieving the movement as a combination of a vertical movement and a lateral movement.

The inner forming rolls 4 and 6 are chosen so that the effective forming angle $\theta_E$ of the bottom inner forming roll 6 may become larger than the effective forming angle $\theta_M$ of the middle inner forming roll 4.

One preferred embodiment of the roll-forming apparatus according to the present invention is constructed as described in detail above, and when the operation of this apparatus has been commenced, as shown in FIG. 4, the raw material disc 1 can be formed while being rotated under the condition that it is clamped between the inner forming die means consisting of the top inner forming die 2, the middle inner forming roll 4 and the bottom inner forming roll 6, and the outer forming die means consisting of the top outer forming die 3, the middle outer forming roll 5 and the bottom outer forming roll 7. Then, since the die for forming the inside of the raw material disc 1 is divided into the top inner forming die 2, the middle inner forming roll 4 and the bottom inner forming roll 6 so that the inner forming die may be composed of these partial dies, great reduction of the cost of die can be achieved. Furthermore, since the inner die can be completely established by these partial dies over the entire forming range of the outer forming die means, the inner forming die means consisting of the three partial dies can achieve the same effect as the integral die in the prior art, and so, the forming of the raw material disc 1 into an end plate can be effected easily.

In addition, since the middle inner forming roll 4 and the bottom inner forming roll 6 have their forming ranges partly overlapped with each other, the forming of the end plate can be carried out smoothly, generation of burr on the inside of the end plate would not occur, and forming at a high precision can be realized.

More particularly, in case where the forming ranges of the inner forming rolls 4 and 6 were not partly overlapped, it was experimentally confirmed that the raw material was squeezed into the space having a gap distance a between the middle inner forming roll 4 and the bottom inner forming roll 6 as shown in FIG. 5, resulting in unacceptable forming of the inside surface of the raw material disc 1. Whereas, according to the present invention, it has been confirmed that by partly overlapping the forming ranges of these middle and bottom inner forming rolls 4 and 6 with each other, the aforementioned disadvantages can be eliminated and thereby good forming can be achieved.

Furthermore, since the top inner forming die 2, the middle inner forming roll 4 and the bottom inner forming roll 6 constituting the inner forming die means are fixed in position after they have been set at predetermined positions, and the fixed state of these members is maintained during the forming of the raw material disc 1, the rigidity of the apparatus can be chosen sufficiently large, and therefore, the method and apparatus according to the present invention are effective for forming a large-sized thick-walled end plate. Still further, since position control for the inner forming die means is unnecessary during the forming operation, not only the forming operation is easy, but also the raw material disc 1 can be formed while being kept in tight contact with the respective partial dies, and so forming at a high precision is made possible.

In addition, since the outer forming rolls 5 and 7 are provided respectively, at the positions opposed to the middle inner forming roll 4 and the bottom inner forming roll 6 either singly or in multiple, it is possible to achieve forming at the same time with the both outer forming rolls 5 and 7, so that the forming of the raw material disc 1 can be carried out without forcible forming operation and the forming of an end plate can be achieved with a small amount of thinning.

Furthermore, since the effective forming angle $\theta_E$ of the bottom inner forming roll 6 is chosen larger than the effective forming angle $\theta_M$ of the middle inner forming roll 4, the following advantage can be obtained. More particularly, as shown in FIG. 6, in case where the effective forming angles $\theta_M$ and $\theta_E$ of the middle inner forming roll 4 and the bottom inner forming roll 6, respectively, are chosen equal to each other, the relation between the maximum diameters d and g of the respective inner forming rolls 4 and 6 are calculated as follows.

In FIG. 6, under the above-assumed condition, $\theta_E=\theta_M$ is fulfilled, and further assuming that the amount of overlapping r (see FIG. 4) between the inner forming rolls 4 and 6 is equal to zero, point B is located at the same level as point D on the opposite sides of the central vertical axis. Then the maximum diameters d and g of the respective inner forming rolls 4 and 6 can be calculated geometrically as follows:

$$d = \frac{R + \sqrt{R(33R + 16b)}}{8} - b \quad (1)$$

$$g = \frac{7R - \sqrt{R(33R + 16b)}}{4} \quad (2)$$

substituting $\alpha=b/R$ in the above equations, we obtain $$\frac{d}{g} = \frac{1 - 8\alpha + \sqrt{33 + 16\alpha}}{14 - 2\sqrt{33 + 16\alpha}} \quad (3)$$

Equation (3) gives the ratio of the maximum diameter d of the middle inner forming roll 4 to the maximum diameter g of the bottom inner forming roll 6 as a function of the parameter $\alpha = b/R$ which is the ratio of the radius b of the drive shaft 8 to the radius of curvature R of the inside surface $1_i$ of the raw material disc 1 after formation.

The relation between the ratio d/g and the parameter $\alpha$ given by Equation (3) is diagrammatically shown in FIG. 7. From this figure it is seen that even for the value of the parameter $\alpha = 0$ the ratio d/g is as high as about 2.69, and as the parameter $\alpha$ increases the ratio d/g is also increased. Such a condition will result in an unbalanced structure in the apparatus, and if the effective forming ranges of the inner forming rolls 4 and 6 are partly overlapped with each other by increasing the maximum diameter d for the given maximum diameter g, then disadvantages will be resulted in view of the structure and mechanical strength of the apparatus, and therefore, forming at a high precision will become difficult.

In view of the aforementioned reasons, it is more effective to overlap the effective forming ranges of the both inner forming rolls 4 and 6 by increasing the maximum diameter g. Increasing the maximum diameter g means to increase the effective forming angle $\theta_E$ of the bottom inner forming roll 6, and accordingly, it is seen that the condition of "the angle $\theta_E >$ the angle $\theta_M$" is more effective.

A second preferred embodiment of the present invention illustrated in FIG. 8 is different from the above-described first preferred embodiment illustrated in FIG. 4 in that the axes of the middle inner forming roll 4 and the bottom inner forming roll 6 are tilted, and in that the outer forming rolls 5 and 7 are constructed in a cylindrical form, and owing to the fact that the axes of the both inner forming rolls 4 and 6 are tilted, this modified embodiment has additional advantages that the range of movement for forming (angle $\theta$) of the outer forming rolls 5 and 7 can be selected large, and that slipping between the inner forming rolls 4 and 6 and the raw material disc 1 can be reduced. In addition, it is to be noted that with regard to the configurations of the outer forming dies 5 and 7, while the embodiments shown in FIGS. 4, 5 and 8 employs the same configuration for the outer forming dies 5 and 7, a more effective result will be obtained by selecting the most suitable configurations individually for the respective outer forming rolls 5 and 7 depending upon the shape of the raw material disc 1.

While the roll-forming method and the roll-forming apparatus according to the present invention have been described above, by way of example, in connection to forming of a perfect hemispherical workpiece with reference to FIGS. 4 to 8, the workpiece to be formed by employing the roll-forming method and the roll-forming apparatus according to the present invention should not be limited to the perfect hemispherical workpiece, but it could be an elliptic workpiece as shown in FIG. 9, and as a matter of course, upon forming of such shape of workpieces the present invention is equally applicable. According to the present invention, forming of a hemispherical thick-walled end plate or similar end plates can be achieved easily and quickly with a relatively simple installation, and furthermore, in comparison to the prior art method and apparatus, practical advantages of reducing an installation expense and lowering a cost of products can be attained.

Next, a third preferred embodiment of the present invention which is especially favorable for preventing the generation of forming defects and wall-thinning caused by the top outer forming die upon forming the top portion as shown in FIG. 3, will be described with reference to FIGS. 10, 11 and 12.

FIG. 10 shows in enlarged scale a top forming portion, in which reference numeral 2 designates a top inner forming die, numeral 3a designates a top central outer die which is disposed so that its center axis may come on a vertical line passing through a center of the top inner forming die, and to the bottom end of which is fixedly secured a center portion of a disc-shaped flexible die plate 14. The top central outer die 3a is disposed so as to be vertically movable as shown by arrows in FIG. 10 by means of a drive source not shown. When it is moved downwards, it presses the center portion of the raw material disc 1 against the top inner forming die 2 by the intermediary of the disc-shaped flexible die plate 14, so that the center portion of the raw material disc 1 may be formed into a desired shape by deforming the center portions of both the flexible die plate 14 and the raw material disc 1 in accordance with the curved surface of the top inner forming die 2. This disc-shaped flexible die plate 14 is provided with a plurality of radial notches 14a at equal intervals along its circumferential direction as shown in FIG. 11, so that it may be easily deformed in accordance with the shape of the inner peripheral surfaces of the top central outer die 3a and a top peripheral outer die 3b as described later and also in accordance with the shape of the outer peripheral surface of the top inner forming die 2. However, it is to be noted that the notches 14a need not be provided in multiple but even a single notch may be sufficient in some case, and furthermore, besides the notch shape shown in FIG. 11, a different shape of notches such as shown in FIG. 12 could be employed. In essence, the reason for providing the notches 14a is to the end that when the disc-shaped flexible die plate 14 is pressed against the top inner forming die 2 by the top central and peripheral outer dies 3a and 3b, the flexible die plate 14 may smoothly deform along the outer peripheral surface of the top inner forming die 2 and the variation of the plate thickness may be limited to minimum. With regard to the shape of the notches 14a, so long as it may leave some clearance after deformation of the die plate, any shape could be employed. The top peripheral outer die 3b is disposed coaxially with and around the above-described top central outer die 3a in a vertically movable manner, and it takes a cylindrical form which is freely rotatable and which can be vertically moved by a drive source not shown. When the top peripheral outer die 3b is moved downwards by the drive source, it depresses the periphery of the central portion of the raw material disc 1 against the outer surface of the top inner forming die 2 by the intermediary of the peripheral portion of the flexible die plate 14, so that the periphery of the central portion of the raw material disc 1 may be formed according to the shape of the top inner forming die 2.

Upon forming the top portion of the raw material disc 1, at first the top central outer die 3a and the top peripheral outer die 3b are set at their raised positions, and thereafter the raw material disc 1 is interposed at a predetermined position between the disc-shaped flexible die plate 14 fixedly secured to the bottom end of the top central outer die 3a and the top inner forming die 2 as shown by a double-dot chain line in FIG. 10. At this state the flexible die plate 14 takes a flat shape as shown also by a double-dot chain line in the same figure. Subsequently, when the top central outer die 3a and the top peripheral outer die 3b are depressed by means of drive sources associated therewith, the flexible die plate 14 is depressed towards the top inner forming die 2, and is deformed jointly with the raw material disc 1 in accordance with the outer surface of the top inner forming die 2 to be formed into a desired shape. In this modified embodiment, the top central outer die 3a and the top peripheral outer die 3b do not make direct contact with the raw material disc 1, but they press the raw material disc 1 uniformly against the top inner forming die 2 by the intermediary of the flexible die plate 14, so that the depressing load can be uniformly distributed. Accordingly, generation of forming defects and wall-thinning of the raw material disc can be greatly reduced in comparison to the prior art method and apparatus, and practically advantageous effects can be attained according to the present invention.

We claim:

1. A method for roll-forming an end plate, characterized by the steps of placing a raw material disc between outer die means and inner die means, said outer die means consisting of a top outer forming die that can be vertically moved by a drive source and can be freely rotated and at least a pair of left and right outer forming rolls adapted to move along predetermined moving paths, said inner die means consisting of a top inner forming die held at a predetermined position that can be driven in rotation by a drive source, and a middle inner forming roll and a bottom inner forming roll both of which are freely rotatable; depressing said outer die means against said inner die means with said raw material disc clamped therebetween; and moving said pair of outer forming rolls along said moving paths so as to press said raw material disc against said middle inner forming roll and said bottom inner forming roll, respectively, one of said outer forming rolls being moved within an effective forming range of said middle inner forming roll, while the other being moved within an effective forming range of said bottom inner forming roll, and the effective forming ranges of said middle and bottom inner forming rolls, respectively, being partly overlapped with each other, whereby said raw material disc may be formed into a desired configuration defined by any suitable surface of revolution.

2. A method for roll-forming an end plate as claimed in claim 1, further characterized in that said top outer forming die is composed of a top central outer die having at its bottom end a disc-shaped flexible die plate provided with at least one radial notch at its peripheral portion that can be vertically moved by a drive source, and a top peripheral outer die disposed coaxially with and around said top central outer die that can be vertically moved by a drive source, whereby said raw material disc may be pressed against said top inner forming die by said top central outer die and said top peripheral outer die by the intermediary of said disc-shaped flexible die plate.

3. An apparatus for roll-forming an end plate, characterized in that said apparatus comprises outer die means consisting of a top outer forming die that can be vertically moved by a drive source and can be freely rotated and at least a pair of left and right outer forming rolls adapted to move along predetermined moving paths, and inner die means consisting of a top inner forming die held at a predetermined position that can be driven in rotation by a drive source and a middle inner forming roll and a bottom inner forming roll both of which are freely rotatable, that when said pair of outer forming rolls move along their moving paths, one of the rolls is adapted to be pressed against said middle inner forming roll within its effective forming range while the other is adapted to be pressed against said bottom inner forming roll within its effective forming range, that the effective forming ranges of said middle and bottom inner forming rolls, respectively, are partly overlapped with each other, and that an effective forming angle of said bottom inner forming roll is chosen larger than an effective forming angle of said middle inner forming roll.

4. An apparatus for roll-forming an end plate as claimed in claim 2, further characterized in that said top outer forming die is composed of a top central outer die having at its bottom end a disc-shaped flexible die plate provided with at least one radial notch at its peripheral portion that can be vertically moved by a drive source, and a top peripheral outer die disposed coaxially with and around said top central outer die that can be vertically moved by a drive source, whereby a raw material disc placed between said outer die means and said inner die means may be pressed against said top inner forming die by said top central outer die and said top peripheral outer die by the intermediary of said disc-shaped flexible die plate.

* * * * *